US006726197B2

(12) United States Patent
Aoki

(10) Patent No.: US 6,726,197 B2
(45) Date of Patent: Apr. 27, 2004

(54) DEVICE FOR CONVEYING A DOCUMENT IN AN IMAGE READING APPARATUS

(75) Inventor: Minoru Aoki, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 117 days.

(21) Appl. No.: 10/086,686

(22) Filed: Mar. 4, 2002

(65) Prior Publication Data

US 2002/0125632 A1 Sep. 12, 2002

(30) Foreign Application Priority Data

Mar. 5, 2001 (JP) ..... 2001-060599
May 2, 2001 (JP) ..... 2001-135005
Jan. 30, 2002 (JP) ..... 2002-022052

(51) Int. Cl.[7] ..... B65H 5/26; B65H 83/00
(52) U.S. Cl. ..... 271/3.06; 271/3.04
(58) Field of Search ..... 271/3.14, 3.17, 271/3.06, 3.09; 198/502.4; 250/559.4; B65H 5/22, 83/00, 85/00

(56) References Cited

U.S. PATENT DOCUMENTS 5,981,891 A * 11/1999 Yamashita et al. ..... 209/584
2003/0011121 A1 * 1/2003 Kobayashi et al. ..... 271/3.14

FOREIGN PATENT DOCUMENTS

JP 3-26616 * 2/1991 ..... B65H/3/06
JP 4-75965 3/1992
JP 10-93760 4/1998

* cited by examiner

*Primary Examiner*—Donald P. Walsh
*Assistant Examiner*—Kenneth W Bower
(74) *Attorney, Agent, or Firm*—Oblon, Spivak, McClelland, Maier & Neustadt, P.C.

(57) ABSTRACT

A device for conveying a document of the present invention includes an insertion sensor for sensing a document inserted into the device. A conveying member conveys the document to a preselected reading position. A discharging member drives the document read out of the device. A discharge sensor senses the trailing edge of the document at a position adjoining the discharging member. When the discharge sensor senses the trailing edge of the document being discharged by the discharging member, a controller interrupts the operation of said discharging member. When the insertion sensor senses the next document after the discharging member has nipped the trailing edge of the preceding document, the controller inhibits the conveying member from conveying the next document.

38 Claims, 9 Drawing Sheets

DEVICE FOR CONVEYING A DOCUMENT IN AN IMAGE READING APPARATUS

BACKGROUND OF THE INVENTION

1. Field of the Invention

The present invention relates to a device installed in a document reading apparatus for conveying a document. More particularly, the present invention relates to a document conveying device including an outlet roller pair configured to nip the trailing edge of a document read and being discharged for thereby preventing the document from dropping.

2. Description of the Background Art

A copier, scanner or similar image reading apparatus of the type conveying documents of relatively large sizes includes a document conveying device. Japanese Patent Laid-Open Publication Nos. 4-75956 and 10-93760, for example, disclose a document conveying device capable of preventing a document read from dropping when it is driven out of the apparatus. For this purpose, the document conveying device stops driving an outlet roller pair when an outlet sensor senses the trailing edge of the document being discharged. As a result, the outlet roller pair stops rotating while nipping the trailing edge of the document.

The above conventional document conveying device has the following problem left unsolved. Assume that the operator of the apparatus inserts a document without pulling out the document S' nipped by the outlet roller pair. Then, the outlet roller pair rotates and releases the document and therefore causes it to drop.

SUMMARY OF THE INVENTION

It is an object of the present invention to provide a document conveying device capable of preventing a document being discharged from dropping and enhancing drivability.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1A:
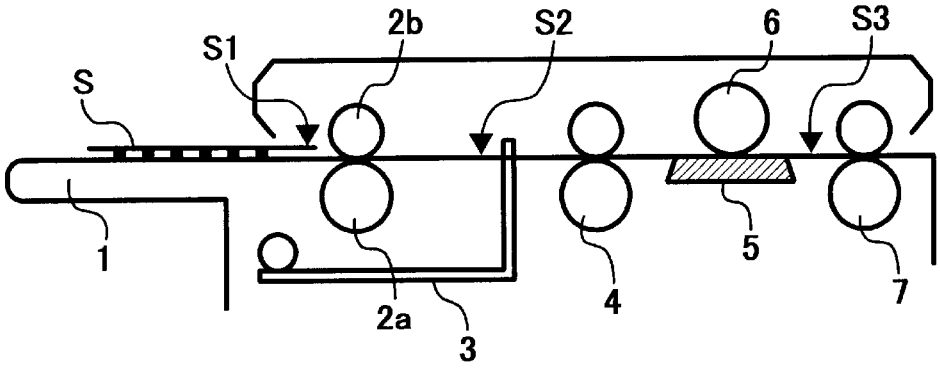
FIG. 1A PRIOR ART
FIGS. 1A and 1B are sectional side elevations showing a conventional document conveying device.
Figure 1B:
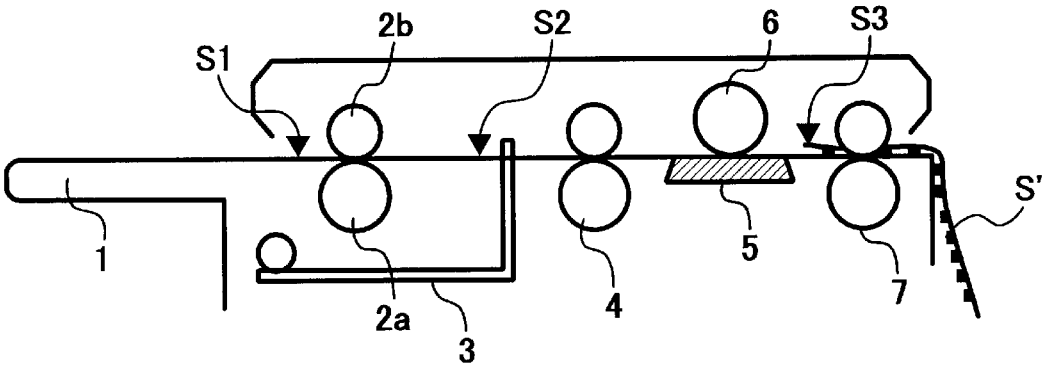
FIG. 1B PRIOR ART

To better understand the present invention, brief reference will be made to a conventional document conveying device for a copier, scanner or similar image reading apparatus, shown in FIGS. 1A and 1B. As shown in FIG. 1A, the document conveying device includes a document table 1. The operator of the device lays a document on the document table 1 and then inserts it into a nip between an drive inlet roller 2*a* and a driven inlet roller 2*b* by hand. As soon as an inlet sensor S1 turns on, the driven inlet roller 2*b* is retracted upward with the result that the leading edge of the document S abuts against a stop 3 and turns on a start sensor S2. In response, the driven inlet roller 2*b* is again lowered. At the same time, the stop 3 is lowered. The driven inlet roller 2*b* and drive inlet roller 2*a* nip the document S to thereby convey it to a registration roller 4. The registration roller 4 conveys the document S to a position between a glass platen 5 and a roller 6. At this position on the glass platen 5, the document S is illuminated and read. As shown in FIG. 1B, an outlet roller 7 drives the document read, labeled S', out of the device. Timing belts, not shown, are respectively passed over the shaft of the drive inlet roller 2*b* and that of the outlet roller 7 and the output shaft of a motor, not shown, so that the document S can be conveyed at preselected timing.

As shown in FIG. 1B, to prevent the document S' from dropping, the outlet roller 7 stops rotating when an outlet sensor S3 senses the trailing edge of the document S', retaining the trailing edge of the document S'. The operator pulls out the document S' retained by the outlet roller 7 and then inserts the next document into the nip between the driven inlet roller 2*a* and the drive inlet roller 2*b*.

The conventional device described above has the problem discussed earlier. Specifically, the drive inlet roller 2*b* and outlet roller 7 are driven by the motor in synchronism with each other. Assume that the operator inserts the next document without pulling out the previous document S' whose trailing edge is retained by the outlet roller 7. Then, the outlet roller 7 rotates and releases the document S', causing the document S' to drop.

Preferred embodiments of the document conveying device in accordance with the present invention will be described hereinafter. While the following description will concentrate on a digital copier, the present invention is, of course, applicable to a scanner or similar image reading device or a facsimile apparatus, laser printer or similar image forming apparatus as well.

Figure 2:
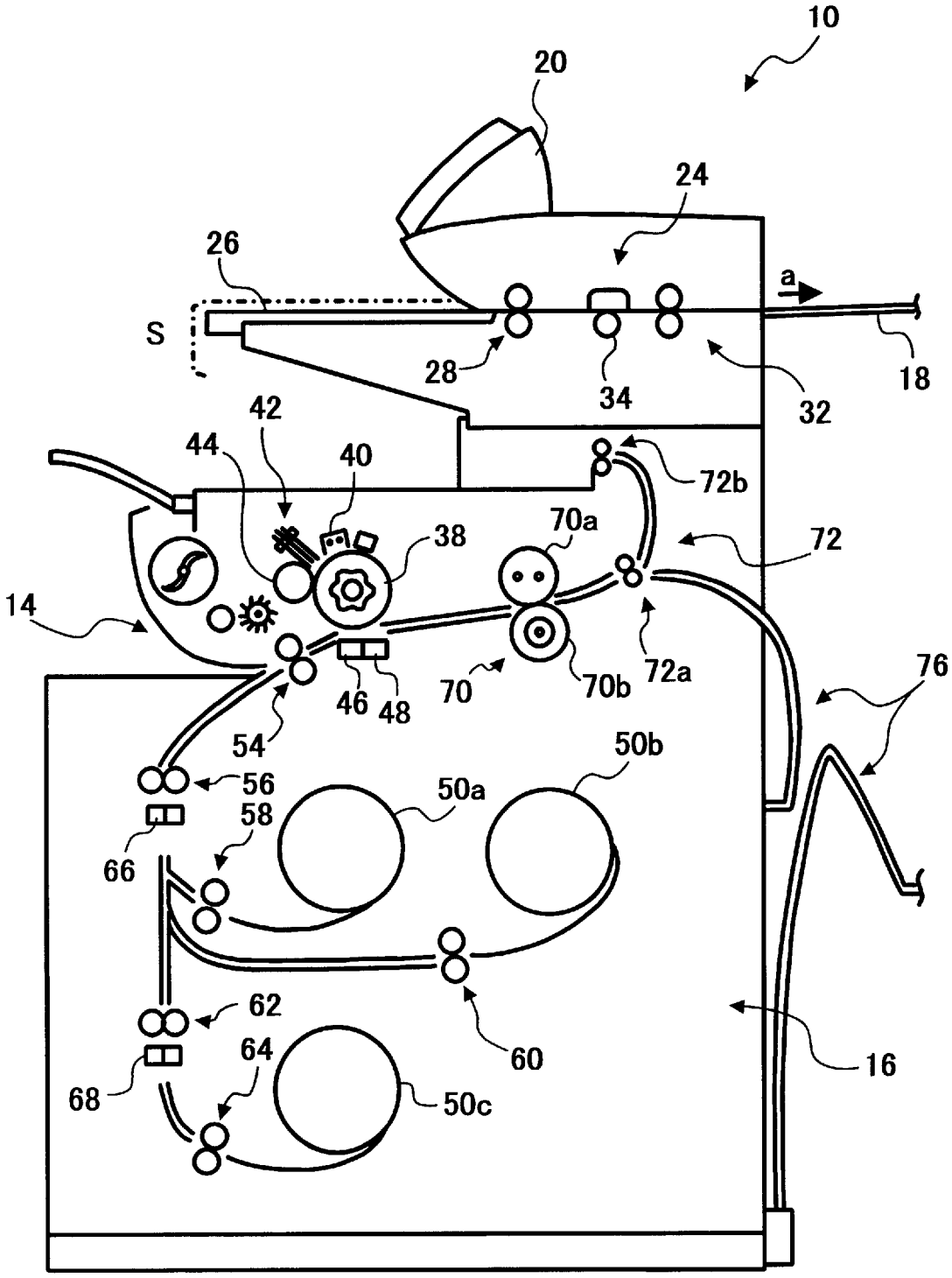
FIG. 2 is a view showing an image reading apparatus to which a document reading device embodying the present invention is applied.

Referring to FIG. 2, a document conveying device embodying the present invention and a digital copier including the same are shown. As shown, the digital copier are generally made up of a document or sheet conveying device 10 mounted on the copier body and an image forming unit 14 and a sheet feeding unit 16 arranged in the copier body. The document conveying device 10 will sometimes be referred to as an ADF (Automatic Document Feeder) hereinafter.

The ADF 10 is made up of an upper unit and a lower unit to which the upper unit is hinged or otherwise connected in such a manner as to be openable. A control panel 20 is mounted on the top of the upper unit and oriented toward the front of the copier body where the operator of the copier is expected to stand. The control panel 20 includes an LC (Liquid Crystal) touch panel and various keys including a start key, numeral keys, a clear/stop key and mode keys, allowing the operator to select a desired operation mode and to start or stop the operation of the copier. The LC touch panel sequentially displays various pictures each including various function keys and a message area. Commands entered on the control panel 20 by the operator are sent to a controller 22 (see FIG. 4).

A reading section 24 is implemented as a scanner unit including a SELFOC lens array, a CCD (Charge Coupled Device) or similar linear sensor and a scanner motor. The scanner unit illuminates a document inserted from the front of the copier body. The resulting reflection from the document is incident to the linear sensor and sequentially converted to an image signal or image data thereby.

A document table 26 is mounted on the top front portion of the lower unit of the ADF 10. A table 26 protrudes from the rear of the lower unit for receiving the document driven out via the reading section 24. The operator lays a document S on the document table 26 face up and then inserts it into the ADF 10. The document table 26 guides the document S to the nip of a feed roller 28, i.e., a driven feed roller 28*a* and a drive feed roller 28*b* (see FIG. 3).

Figure 3:
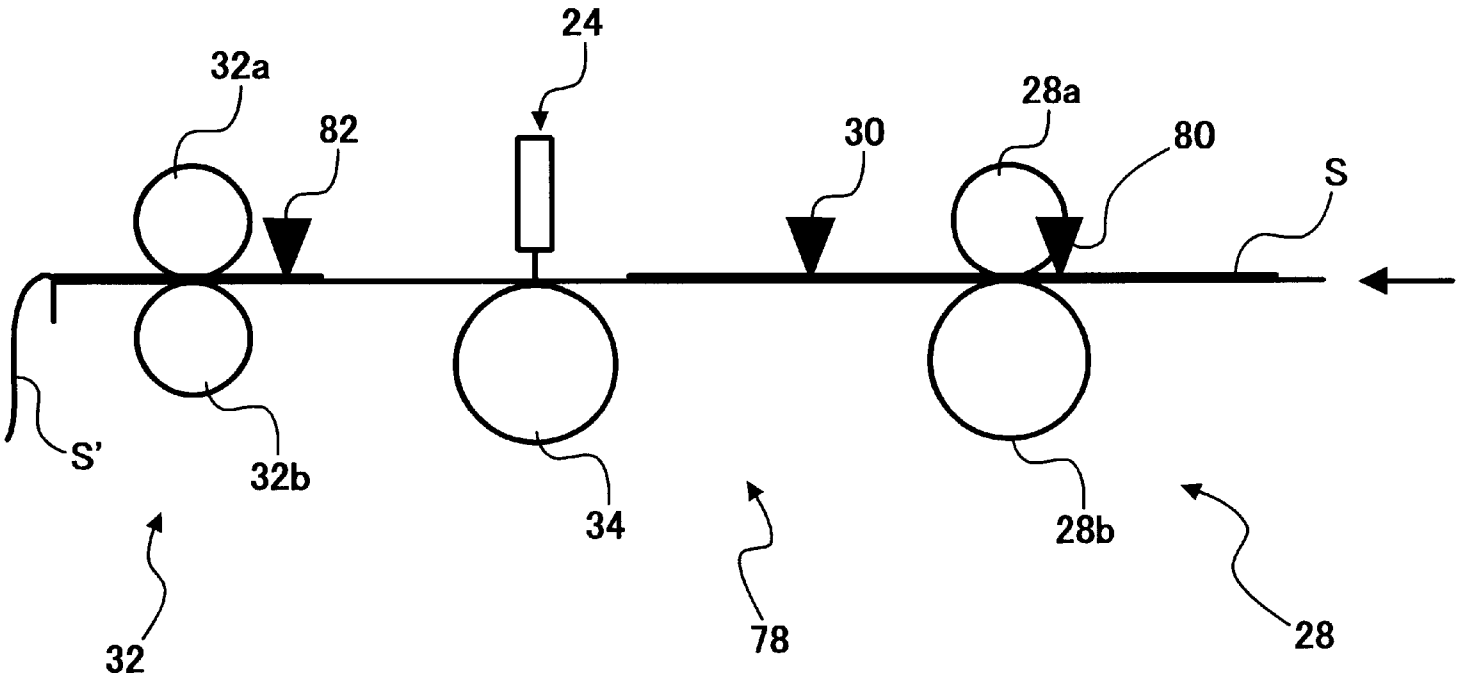
FIG. 3 is a fragmentary view showing essential part of the illustrative embodiment.

As shown in FIG. 3, a registration sensor 30 is located upstream of the reading section 24 and implemented as an optical reflection type sensor. The registration sensor 30 turns on when the leading edge of the document S reaches the scanning line of the reading section 24 and then turns off when the trailing edge of the document S moves away from the scanning line. A motor for conveyance, not shown, is deenergized when the registration sensor 30 turns off.

The table 18 is inclined upward toward the downstream side in the direction of document conveyance and implemented by metallic wires arranged in a comb configuration. An outlet roller, i.e., a driven outlet roller 32*a* and a drive outlet roller 32*b* (see FIG. 3) drive the document S out of the copier body via an outlet contiguous with the table 18.

Figure 4:
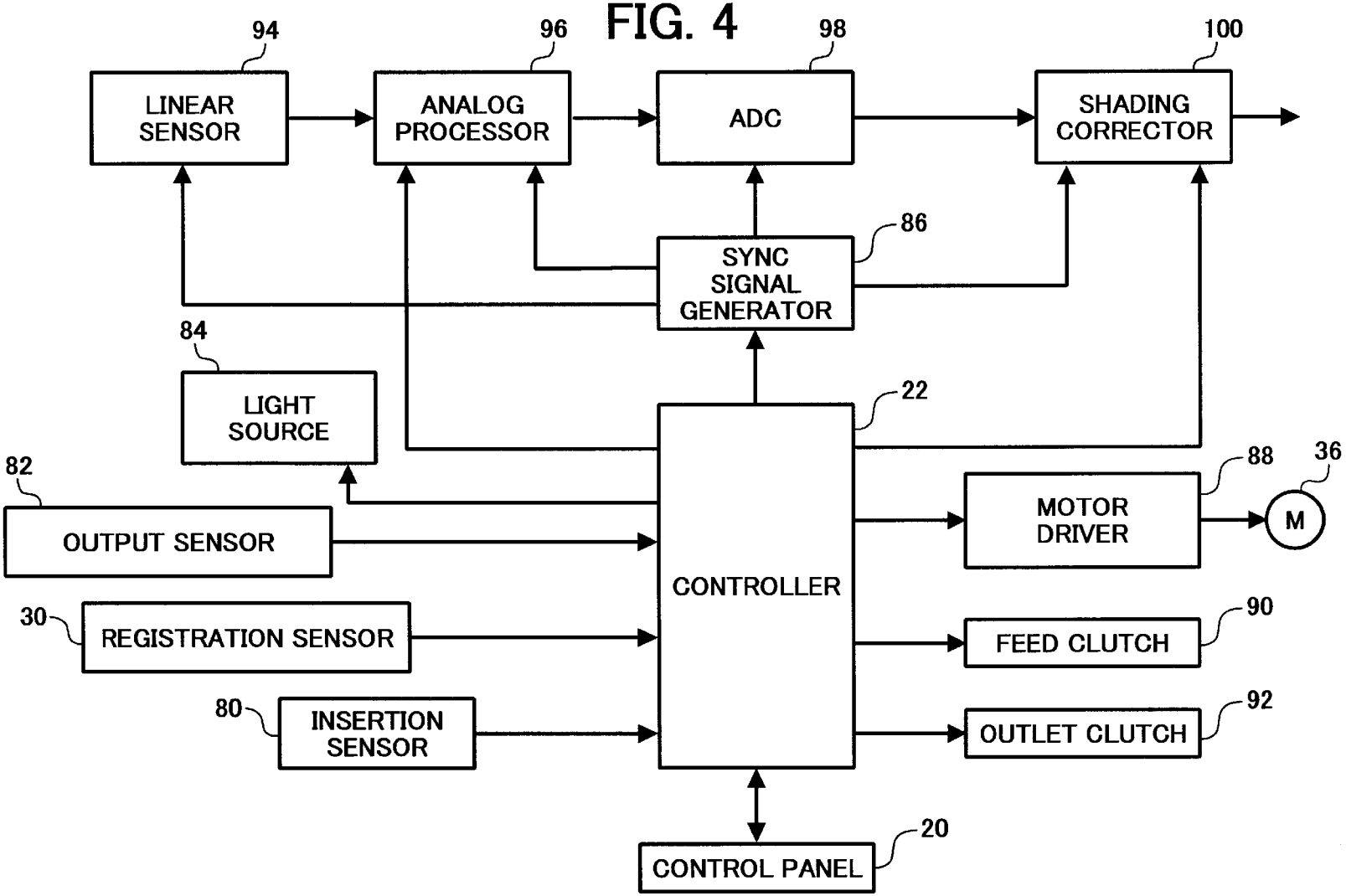
FIG. 4 is a schematic block diagram showing a control system included in the illustrative embodiment.

The motor for conveyance, labeled 36 in FIG. 4, is implemented as a stepping motor and cause each of the feed roller 28, a white roller 34 and the outlet roller 32 to reversibly rotate. The copier body feeds power to the motor 36.

The image forming unit 14 includes a photoconductive element implemented as a drum 38. Arranged around the drum are a main charger 40, a writing unit 42, a developing unit 44, an image transfer charger 46, and a separation charger 48. The writing unit 42 is laser writing optics including a laser unit, a focusing lens, and mirrors. The laser unit includes a laser diode and a polygonal mirror.

The sheet feeding unit 16 is positioned below the image forming unit 14 and includes paper rolls 50*a*, 50*b* and 50*c*. A vertical conveying unit includes feed rollers 54, 56, 58, 60, 62 and 64 and cutters 66 and 68. The vertical conveying unit cuts paper paid out from any one of the paper rolls 50*a* through 50*c* at a preselected length in accordance with the length of the document C while conveying it. A belt conveyor, a fixing unit 70, a paper discharging unit 72 and a copy tray 76 are sequentially arranged in this order downstream of the image transfer position of the drum 38 in the direction of paper conveyance. The fixing unit 70 includes a heat roller 70*a* and a press roller 70*b*. The paper discharging unit 72 includes rollers 72*a* and 72*b*.

In operation, the paper paid out from any one of the paper rolls 50*a* through 50*c* is cut by the vertical conveying unit in accordance with the length of the document S and conveyed to the image transfer position of the drum 38 thereby. The writing unit 42 scans the surface of the drum 38, which is rotating in the subscanning direction, imagewise in the main scanning direction, thereby forming a latent image. The developing unit 44 develops the latent image to thereby produce a corresponding toner image. The belt conveyor mentioned earlier conveys the cut paper at the same speed as the rotation speed of the drum 38 such that the leading edge of the paper meets the leading edge of the toner image. After the toner image has been transferred from the drum 38 to the paper, the fixing unit 70 fixes the toner image on the paper. The paper with the fixed toner image, i.e., a copy is driven out to the copy tray 76 via either one of the outlet rollers 72*a* and 72*b* in accordance with the paper size.

FIG. 3 shows the essential part of the copier. In the condition shown in FIG. 3, the driven outlet roller 32*a* and drive outlet roller 32*b* have nipped and stopped the trailing edge of the document read, labeled S', while the leading edge of the next document S has arrived a position close to the reading position and stopped there. As shown, a conveying section 78 conveys the document S inserted from the front of the copier (leftward in FIG. 3) toward the rear of the same (direction of document conveyance, illumination or document discharge). The reading section 24 reads the document S conveyed to a scanning position (scanning line) on a glass platen.

The conveying section 78, which forms part of the ADF 10, includes the document table 26, outlet roller 32, table 18, white roller 34 and registration sensor 30 as well as an insertion sensor 80 and an outlet sensor 82. The document table 26 is expected to lay the document S of relatively large size, e.g., size A2 or A3. The outlet roller 32 conveys the document S' read from the reading position rearward (direction a, FIG. 2) when in forward rotation and nips the trailing edge of the document S'. The document S' read is driven out to the tray 18. The white roller 34 is positioned below the glass platen for guiding the document S. The registration sensor 30 is positioned upstream of the reading position for sensing the document S. The insertion sensor 80 is positioned upstream of the feed roller 28 for sensing the document S inserted. The outlet sensor 82 senses the trailing edge of the document S' read.

The driven feed roller 28*a* and drive feed roller 28*b*, constituting the feed roller 28, are formed of, e.g., hard rubber and have the same coefficient of friction as each other. Timing belts, not shown, are respectively passed over the output shaft of the stepping motor 36 and the shaft of the drive feed roller 28*b* and that of the drive outlet roller 32*b*. The stepping motor 36 causes the two rollers 28*b* and 32*b* to convey the document S in synchronism with the document scanning operation. The controller 22, which will be described later, controllably drives the stepping motor 36.

The reading section 24 is positioned above the glass platen and includes a light source or light 84 (see FIG. 4) as well as the SELFOC lens array and linear sensor mentioned earlier.

Referring to FIG. 4, the controller 22 includes a CPU (Central Processing Unit), memories including a ROM (Read Only Memory), a RAM (Random Access Memory) and a nonvolatile memory, an I/O (Input/Output) section and an interface, although not shown specifically. The control panel 20, insertion sensor 80, registration sensor 30 and outlet sensor 82 are connected to the controller 22. The controller 22 outputs an ON/OFF signal and a clock signal in accordance with signals input from the above sections. More specifically, the controller 22 controls a synchronizing (SYNC) signal generator 86, a motor driver 88 connected to the stepping motor 36, a feed clutch 90 and an outlet clutch 92 as well as the light source 84.

The stepping motor 36 allows the controller 22 to easily determine a distance of conveyance by multiplying, e.g., the number of steps or pulses by a distance for a single step.

The controller 22 additionally includes a timer, not shown, for setting, e.g., an interval between the turn-on of the insertion sensor 80 and the start of document conveyance. In the illustrative embodiment, the above interval is selected to be, but not limited to, 1 second to 3 seconds. The timer provides the manual document setting time with a margin. More specifically, just after the turn-on of the insertion sensor 80, the document S may not have been fully inserted or may have been inserted in an oblique position. In such a case, the timer allows the operator to fully insert the document S or to reposition it. The interval should preferably be shortened or extended in accordance with the operator's expertness or the document size. In the illustrative embodiment, the operator can control the interval via the control panel 20.

The SYNC signal generator 86 feeds a clock and addresses to a linear sensor 94, an analog processor 96, an ADC (Analog-to-digital Converter) 98, and a shading corrector 100. The analog processor 96 controls the level of an analog image signal output from the linear sensor 94 while executing sampling and holding as well as gain control. The ADC 98 converts the analog image signal to an eight-bit digital image signal. More specifically, when the document S is absent on the white roller 34, an AGC (Automatic Gain Control) circuit, not shown, maintains the maximum output of the ADC 98 at a preselected value, e.g., 220.

The shading corrector 100 corrects the irregular distribution of the quantity of light issuing from the light source 84 in the main scanning direction. Also, the shading corrector 100 corrects irregularity in the image signal in the main scanning direction ascribable to characteristics particular to CCDs, which constitute the linear sensor 94, to the ADC 98. More specifically, the shading corrector 100 executes correction with each pixel of the linear sensor 94 by using an equation:

$$\text{corrected data}=(\text{image data}/\text{reference data})\times 255 \qquad \text{Eq. (1)}$$

In the Eq. (1), the reference data refers to data output from the ADC 98 when the document S is absent on the white roller 34, and subjected to AGC. AGC and shading correction are conventional and will not be described specifically. AGC may be effected when a main switch, not shown, mounted on the image reading device is turned on, if desired.

The feed clutch 90 selectively connects the drive feed roller 28*b* to the stepping motor 36. The feed clutch 90 transfers the output torque of the stepping motor 36 to the feed drive roller 28*b* only when it is coupled. Likewise, the outlet clutch 92 transfers of the output torque of the stepping motor 36 to the drive outlet roller 32*b* when it is coupled.

The control panel 20 includes a Yes/No key and cursor keys in addition to the various keys mentioned previously. Further, the control panel 20 includes an LCD (Liquid Crystal Display) and LEDs (Light Emitting Diodes) or similar indicators. Moreover, the control panel 20 produces a video or an audio alarm if the operator intends to insert a new document when the outlet roller 32 is nipping the trailing edge of the previous document S.

Figure 5:
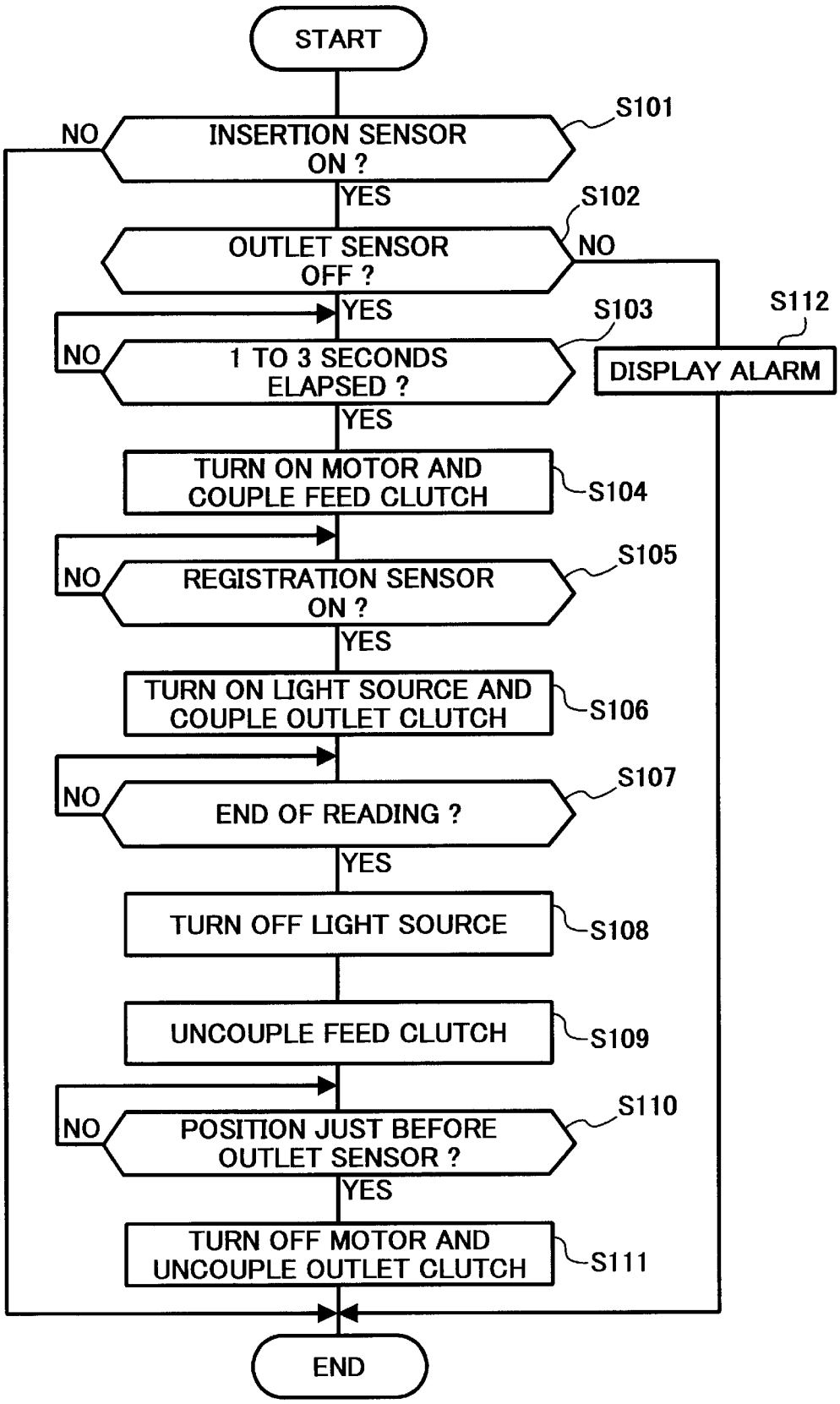
FIG. 5 is a flowchart demonstrating a specific operation of the illustrative embodiment.

A specific operation of the illustrative embodiment will be described with reference to FIG. 5. As shown, when the operator lays a single document S on the document table 26 and inserts it in the direction a, FIG. 2, the insertion sensor 80 senses the leading edge of the document S and turns on (YES, step S101). Assume that the outlet sensor 82 is in an ON state (NO, step S102). Then, the controller 22 determines that the preceding document S' read remains nipped by the outlet roller 32, and displays an alarm message on the control panel 20 (step S112). If the outlet sensor 82 is in an OFF state (YES, step S102), then the controller 22 causes the timer to start counting time. Assume that a preselected period of time, e.g., about 2 seconds elapse since the insertion sensor 80 has sensed the leading edge of the document S (YES, step S103). Then, the controller 22 causes the stepping motor 36 to rotate in the forward direction (direction of conveyance) and couples the feed clutch 90 (step S104). As a result, the output torque of the stepping motor 36 is transmitted to the feed roller 28, causing it to rotate in the direction of conveyance.

Subsequently, the controller 22 determines whether or not the registration sensor 30 has sensed the leading edge of the document S (step S105). If the answer of the step S105 is YES, then the controller 22 turns on the light source 84 and couples the outlet clutch 92 (step S106), causing the outlet roller 32 to rotate in the direction of conveyance. In this condition, the linear sensor 94 and SELFOC lens array read the document S at a position between the glass platen and the white roller 34. After the entire document S has been read (YES, step S107), the controller 22 turns off the light source 84 (step S108). Also, the controller 22 uncouples the feed clutch 90 when the document S moves away from the feed roller 28 (step S109).

The outlet sensor 82 senses the document S' read. Just before the trailing edge of the document S' moves away from the outlet sensor 82 (YES, step S110), the controller 22 turns off the stepping motor 36 and uncouples the outlet clutch 92 (step S111). As a result, the outlet roller 32 stops rotating while nipping the trailing edge of the document S'. The controller 22 memorizes this condition. This is the end of the procedure for reading the first document. The steps described so far do not need the outlet clutch 92.

When the operator pulls out the document S' nipped by the outlet roller 32, the outlet sensor 82 turns off. The controller 22 determines, based on the output of the insertion sensor 80, that the next document S is being inserted. The controller 22 therefore again turns on the stepping motor 36 and couples the feed clutch 90 to thereby drive the feed roller 28. As soon as the registration sensor 30 senses the leading edge of the document S, the controller 22 again turns on the light source 84 and couples the outlet clutch 92. Consequently, the outlet roller 32 stops rotating while nipping the trailing edge of the document S read. Such a procedure is repeated when another document is inserted.

As stated above, the insertion sensor 80 senses the document S inserted into the document conveying device 10. The feed roller 28 conveys the document S to the reading position. The outlet roller 32 drives the document S' read out of the device 10. The outlet sensor 82 senses the trailing edge of the document S' read approached the outlet roller 32. When the outlet roller 32 discharges the document S' read, the outlet sensor 82 senses the trailing edge of the document S'. In response, the controller 22 causes the outlet roller 32 to stop rotating while nipping the trailing edge of the document S'. When the insertion sensor 80 senses the next document S, the controller 22 stops driving the feed roller 28. Therefore, even when the trailing edge of the document S' remains nipped by the outlet roller 32 so as not to drop, the following document S can be conveyed to the preselected position just before the registration sensor 30. This successfully enhances drivability.

Further, when the preceding document S' remains nipped by the outlet roller 32, the controller 22 inhibits conveyance for the insertion of the following document S. At the same time, the controller 22 produces a video alarm message on the control panel 20 or produces an audio alarm speech. This surely urges the operator to pull out the document nipped by the outlet roller 32.

An alternative embodiment of the present invention will be described hereinafter. This embodiment is also practicable with the configurations described with reference to FIGS. 2 through 4 except for a restart key additionally positioned on the control panel 20. In the figures, identical reference numerals designate identical structural elements. Briefly, when the trailing edge of the preceding document S' remains nipped by the outlet roller 32, the operator may press the restart key to feed the following document S and forcibly discharge the preceding document S'. The restart key therefore enhances efficient operation in accordance with the operator's choice.

Specifically, assume that the trailing edge of the preceding document S' is nipped by the outlet roller 32, and that the following document S is in a halt at the position just before the registration position. Then, when the operator presses the restart key, the controller 22 turns on the stepping motor 36 and couples the outlet clutch 92 to thereby forcibly discharge the preceding document S'. The controller 22 then uncouples the outlet clutch 92 and couples the feed clutch 90 for thereby driving the feed roller 28. The controller 22 updates information stored therein when the restart key is pressed.

The controller 22 stores information indicative of whether or not the preceding document S' remains nipped by the outlet roller 32, as in the previous embodiment. On receiving information representative of the operation of the restart key, the controller 22 stores it and turns on the stepping motor 36 and couples the outlet clutch 92 for thereby driving the outlet roller 32. At the same time, the controller 22 couples the feed clutch 90 to thereby drive the feed roller 28.

The controller 22 additionally includes a timer for setting an interval between the stop and the restart of the following document S. Assume that the following document S is in a halt at the position just before the registration sensor 30, and that a period of time To set in the above timer expires without the restart key being pressed. Then, the controller 22 turns on the stepping motor 36 and couples the outlet clutch 92 to thereby rotate the outlet roller 32. At the same time, the controller 22 couples the feed clutch 90 in order to rotate the feed roller 28. The period of time To is adjustable via the control panel 20, as in the previous embodiment, and is about 2 seconds by way of example. More specifically, by varying the period of time To, it is possible to vary the duration of the stop of the following document S at the above position.

Figure 6:
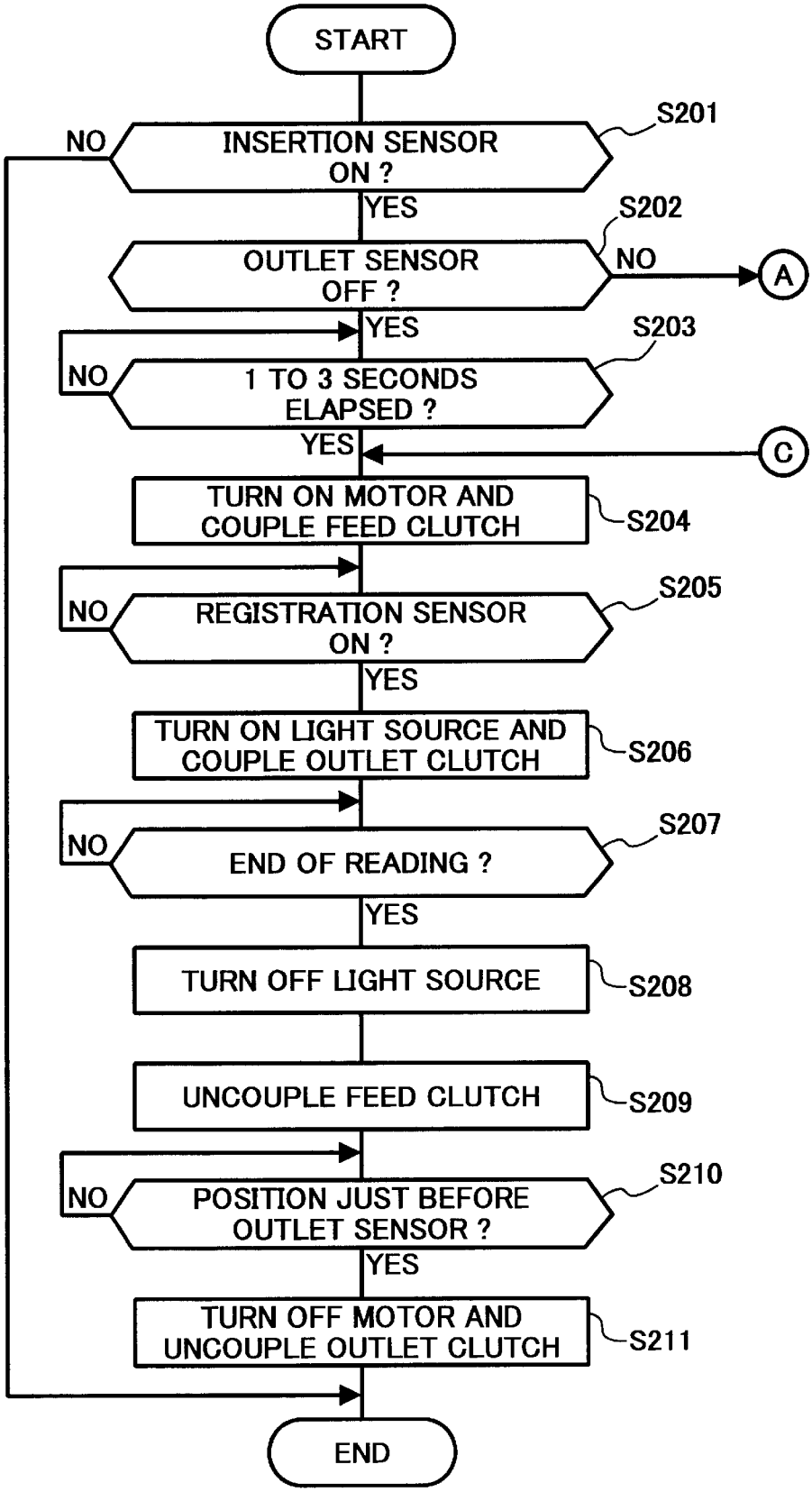
FIGS. 6 through 8 are flowcharts representative of the operation of an alternative embodiment of the present invention.
Figure 7:
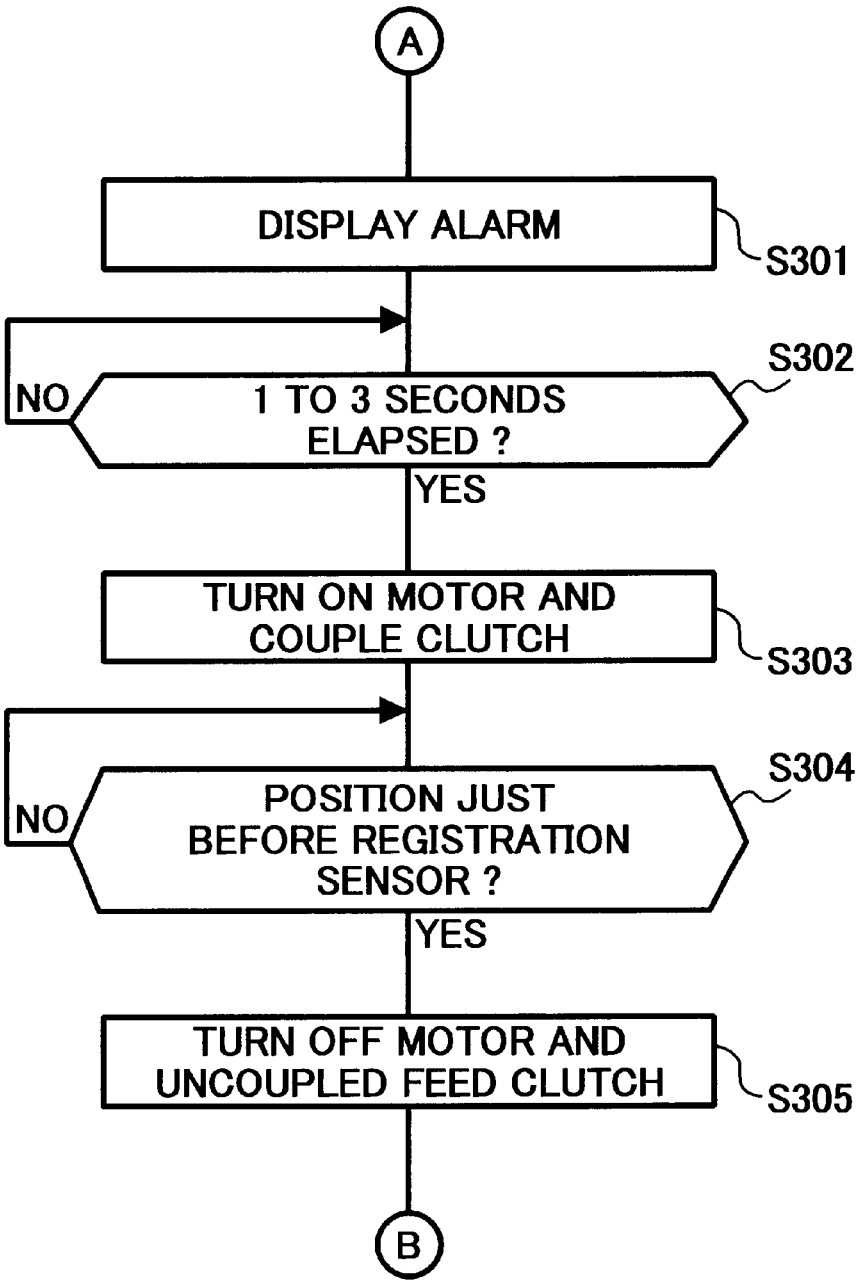
Figure 8:
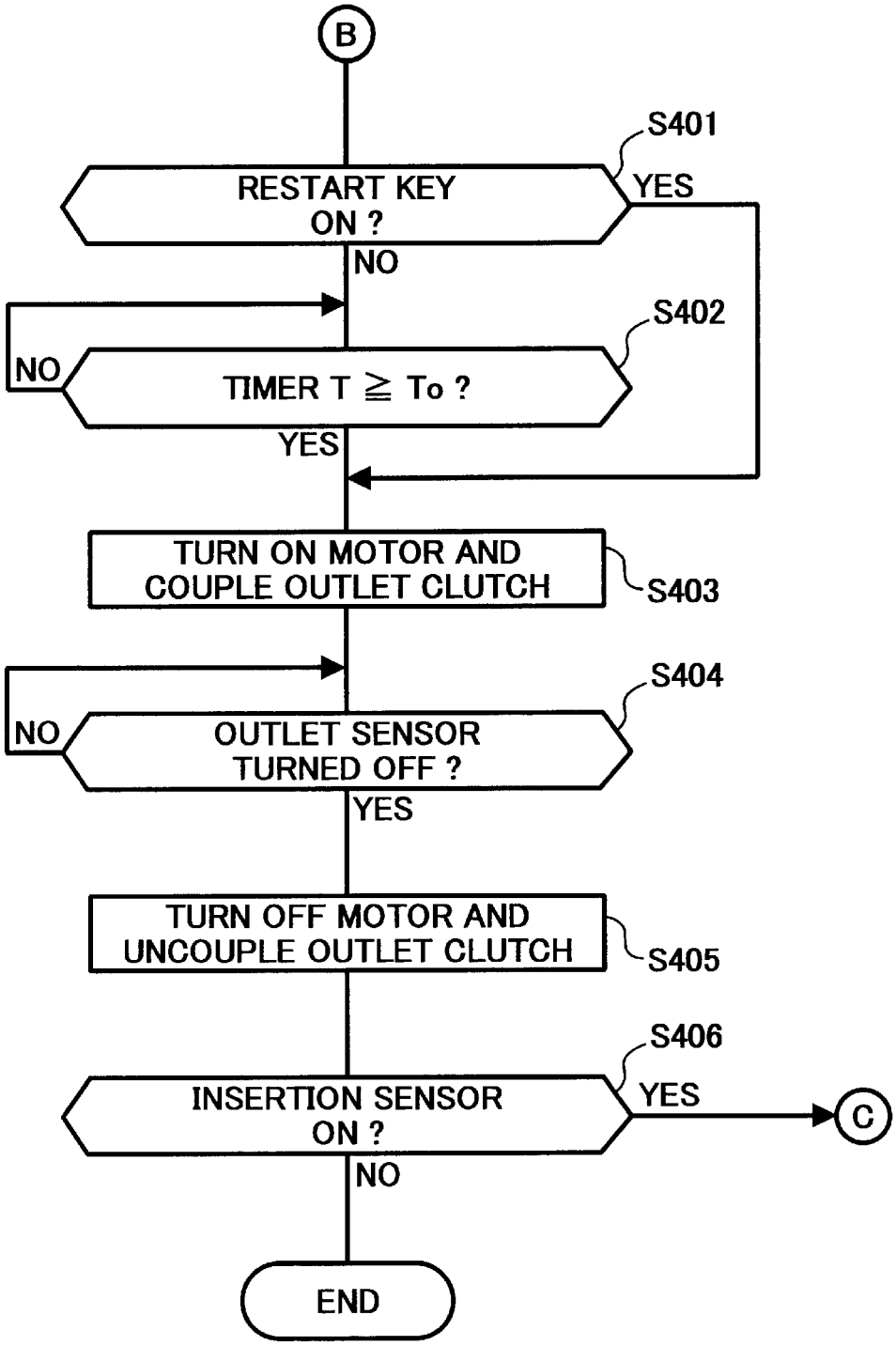

Reference will be made to FIGS. 6 through 8 for describing a specific operation of the illustrative embodiment. As shown, when the operator lays a single document S on the document table 26 and inserts it in the direction a, FIG. 2, the insertion sensor 80 senses the leading edge of the document S and turns on (YES, step S201). Assume that the outlet sensor 82 is in an ON state (NO, step S202). Then, the controller 22 determines that the preceding document S' read remains nipped by the outlet roller 32, and displays an alarm message on the control panel 20 (step S301). Further, the controller 22 causes the timer to start counting time. On the elapse of the preselected period of time, e.g., about 2 seconds (YES, step S302), the controller 22 drives the stepping motor 36 in the forward direction (direction of conveyance) and couples the feed clutch 90 to thereby drive the feed roller 28 (step S303).

As soon as the leading edge of the document S arrives at the position just before the registration sensor 30 (YES, step S304), the controller 22 turns off the stepping motor 36 and uncouples the feed clutch 90 (step S305). As a result, the conveyance of the document S is interrupted for the period of time To, e.g., about 2 seconds. The controller 22 counts time since the interruption of conveyance of the second document S. The controller 22 determines whether or not the restart key has been pressed (step S401). If the answer of the step S401 is negative (NO), then the controller 22 determines whether or not the period of time To has elapsed (step S402).

If the answer of the step S401 is YES, meaning that the restart key has been pressed, then the controller 22 turns on the stepping motor 36 and turns on the light source 84 to thereby drive the outlet roller 32 in the direction of conveyance (step S403). Subsequently, when the outlet sensor 82 turns off (YES, step S404), the controller 22 stops driving the stepping motor 36, turns off the light source 84, and uncouples the outlet clutch 92 (step S405).

Assume that the insertion sensor 80 remains in an ON state by sensing the leading edge of the document S held at the position just before the registration position (YES, step S406). Then, the controller 22 drives the stepping motor 36 in the forward direction (direction of conveyance) and couples the feed clutch 90 for thereby causing the feed roller 28 to rotate, i.e., to again start conveying the document S.

When the registration sensor 30 senses the leading edge of the document S (YES, step S205), the controller 22 turns on the light source 84 and couples the outlet clutch 92 (step S206), causing the outlet roller 32 to rotate in the direction of conveyance. In this condition, the linear sensor 94 and SELFOC lens array read the document S at a position between the glass platen and the white roller 34. After the entire document S has been read (YES, step S207), the controller 22 turns off the light source 84 (step S208). Also, the controller 22 uncouples the feed clutch 90 when the document S moves away from the feed roller 28 (step S209).

The outlet sensor 82 senses the document S' read. Just before the trailing edge of the document S' moves away from the outlet sensor 82 (YES, step S210), the controller 22 turns off the stepping motor 36 and uncouples the outlet clutch 92 (step S211). As a result, the outlet roller 32 stops rotating while nipping the trailing edge of the document S'. The controller 22 memorizes this condition. This is the end of the procedure for reading the first document.

As stated above, the insertion sensor 80 senses the document S inserted into the document conveying device 10. The feed roller 28 conveys the document S to the reading position. The outlet roller 32 drives the document S' read out of the device 10. The outlet sensor 82 senses the trailing edge of the document S' read and approached the outlet roller 32. When the outlet roller 32 discharges the document S' read, the outlet sensor 82 senses the trailing edge of the document S'. In response, the controller 22 causes the outlet roller 32 to stop rotating while nipping the trailing edge of the document S'. When the insertion sensor 80 senses the next document S, the controller 22 causes the feed roller 28 to convey the document S by a preselected distance and then stops the conveyance. Therefore, when the trailing edge of the document remains nipped by the outlet roller 32, the next document can be conveyed to and stopped at a preselected position where it does not interfere with the preceding document, e.g., a position just before the registration sensor 30. This allows the next document to be read in a short period of time.

When the preselected period of time elapses since the stop of the conveyance, the controller 22 causes the document S' read to be discharged. As soon as the insertion sensor 80 senses the next document S, the controller 22 again drives the feed roller 28. Consequently, the preceding document S' is not only nipped by the outlet roller 32 at its trailing edge, but also discharged on the elapse of the preselected period of time. This guarantees an interval between the insertion of the following document S and the receipt of the preceding document S', allowing the operator to perform the entire work alone.

The control panel 20 and controller 22 allow the operator to select a desired period of time up to the discharge of the document in accordance with the size and kind of the document or the operator's expertness.

Moreover, when the conveyance of the preceding document S is interrupted, the restart key allows the operator to again start the conveyance. In response to the output of the restart key, the controller 22 again drives the feed roller 28 and outlet roller 32 without regard to whether or not the preselected period of time has elapsed. More specifically, priority is given to the forcible discharge over the discharge based on the preselected period of time. This also allows the operator to perform the entire work alone.

In the illustrative embodiment, as well as in the other embodiments, when the following document S is stopped at the registration position with the trailing edge of the preceding document S' being nipped by the outlet roller 32, there may be produced a vide and/or an audio message alerting the operator to the preceding document S' nipped by the outlet roller 32. In addition, there may be produced a video and/or an audio message for urging the operator to press the restart key.

Figure 9:
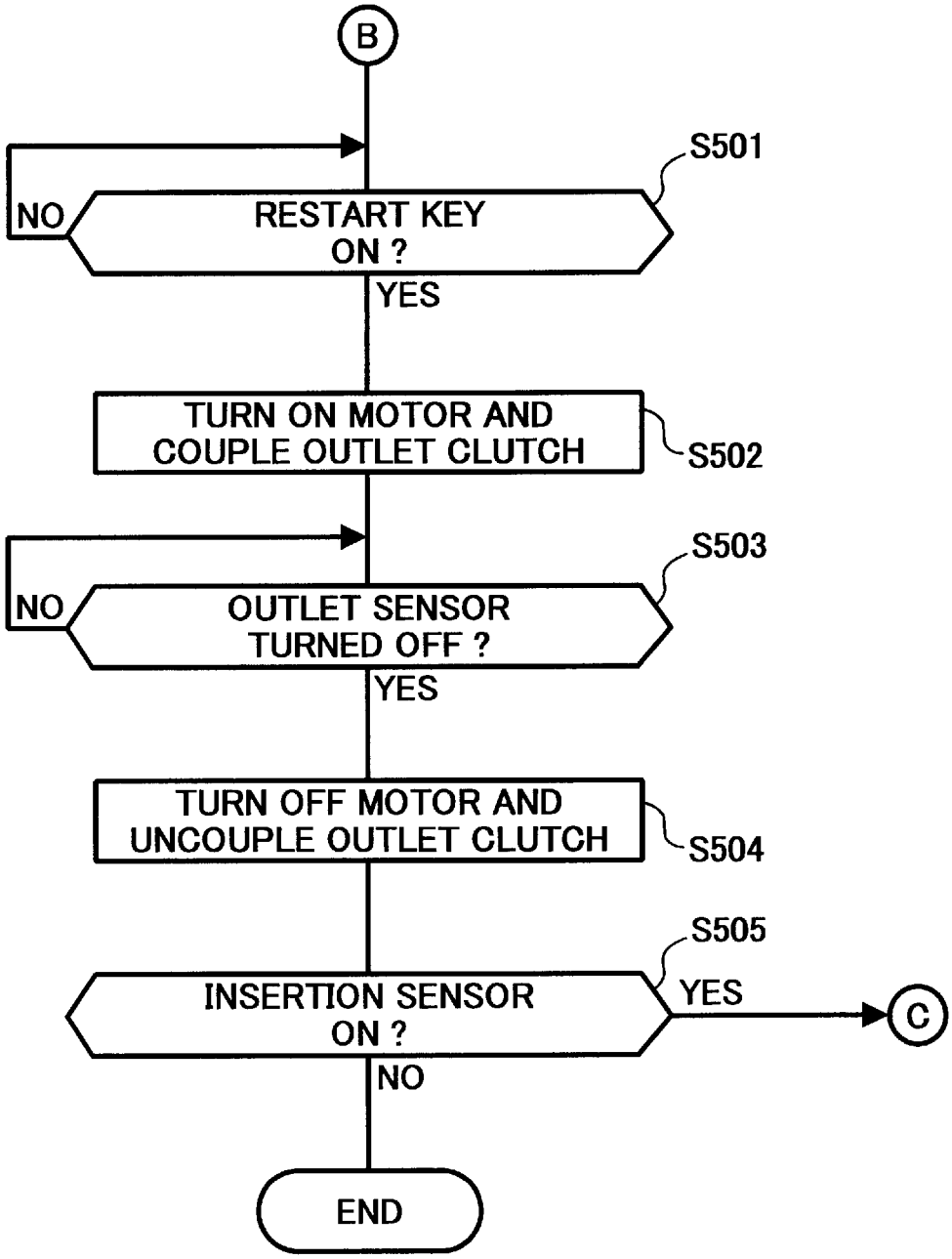
FIG. 9 is a flowchart representative of part of the operation unique to another alternative embodiment of the present invention.

Another alternative embodiment of the present invention will be described hereinafter. This embodiment is generally identical in configuration with the embodiment described with reference to FIGS. 6 through 8. In the figures, identical reference numerals designate identical structural elements. FIG. 9 shows a sequence of steps representative of the illustrative embodiment. The sequence of FIG. 9 is identical with the sequence of the previous embodiment except for the steps S401 through 406 shown in FIG. 8.

In the illustrative embodiment, the controller 22 does not include the timer for setting the interval between the stop and the restart of conveyance of the following document S. As shown in FIG. 9, in response to the output of the restart key (YES, step S501), the controller 22 again causes the outlet roller 32 to discharge the document S' (step S502) and causes the feed roller 28 to again convey the document S (step S204, FIG. 6). The operator can therefore press the restart key at a desired time in order to cause the following document S conveyed by the preselected distance to be again conveyed. At the same time, the document nipped by the outlet roller 32 is driven out of the apparatus. This successfully enhances drivability.

More specifically, when the leading edge of the document S reaches the position just before the registration sensor 30 (step S304, FIG. 7), the controller 22 determines whether or not the operator has pressed the restart key (step S501). If the answer of the step S501 is YES, then the controller 22 drives the stepping motor 36 and couples the outlet clutch 92 for thereby conveying the document S in the direction of conveyance (step S502). When the outlet sensor 82 turns off (YES, step S503), the controller 22 stops driving the stepping motor 36, turns off the light source 84, and uncouples the outlet clutch 92 (step S504). Assume that the insertion sensor 80 remains in an ON state by sensing the leading edge of the document S stopped at the above position (step S506). Then, the controller 22 turns on the stepping motor 30 and couples the feed clutch 90 (step S204, FIG. 6) to thereby again convey the document S.

In the illustrative embodiment, as well as in the other embodiments, assume that when the outlet sensor 82 senses the trailing edge of the preceding document S' being discharged by the outlet roller 32, the outlet roller 32 stops rotating and nips the trailing edge of the document S'. Then, when the insertion sensor 80 senses the following document S, the controller 22 may stop driving the feed roller 28 (corresponding to the step S112, FIG. 5) or cause the feed roller 28 to convey the document S by a preselected distance (corresponding to the steps S303 through S305, FIG. 7). Further, when the outlet sensor 82 senses the trailing edge of the preceding document S' after the following document S has been conveyed by the preselected distance by the feed roller 32, the controller 22 may cause the feed roller 32 to again convey the document S (corresponding to the step S204, FIG. 6, the step S406, FIG. 8 or the step S505, FIG. 9).

Assume that the operator inserts the following document S when the trailing edge of the preceding document S' remains nipped by the outlet roller 32. Then, the operator may selectively cause, via the control panel 20, the controller 22 to inhibit the feed roller 28 from conveying the document S or to cause it to convey the document S by the preselected distance.

In the illustrative embodiment, as well as in the other embodiments, the operator may selectively cause, via the control panel 20, the controller 22 to set either one of a first mode and a second mode. In the first mode, when the preceding document S' remains nipped by the outlet roller 32, the controller 22 inhibits the conveyance of the following document S. In the second mode, the controller 22 allows the document S to be conveyed to the position just before the registration sensor, stopped there, and again conveyed after the preceding document S' has been discharged. The operator can therefore switch the conveying operation and reading operation in accordance with the kind and size of a document and operator's expertness.

The insertion sensor 80 constitutes insertion sensing means. The stepping motor 36, feed clutch 90 and feed roller 28 constitute conveying means. The stepping motor 36, outlet clutch and outlet roller 32 constitute discharging means. The outlet sensor 82 constitutes discharge sensing means. The controller 22 constitutes control means. The control panel constitutes alarm outputting means and commanding means. Further, the controller 22 and operation panel 20 constitute setting means in combination.

Various modifications will become possible for those skilled in the art after receiving the teachings of the present disclosure without departing from the scope thereof.

What is claimed is:

1. A device for conveying documents, comprising:

insertion sensing means for sensing a first document inserted into said device;

conveying means for conveying the first document to a preselected reading position;

discharging means for driving the read first document out of said device;

discharge sensing means for sensing a trailing edge of the read first document at a position adjoining said discharging means;

control means for interrupting, when said discharge sensing means senses the trailing edge of the first document being discharged by said discharging means, an operation of said discharging means and inhibiting, when said insertion sensing means senses a subsequent second document after said discharging means has nipped said trailing edge of said first document, said conveying means from conveying said second document; and alarm outputting means for outputting an alarm message when said insertion sensing means senses the second document after said discharging means has nipped said trailing edge of said first document.

2. A device for conveying documents, comprising:

insertion sensing means for sensing a first document inserted into said device;

conveying means for conveying the first document to a preselected reading position;

discharging means for driving the read first document out of said device;

discharge sensing means for sensing a trailing edge of the read first document at a position adjoining said discharging means; and control means for interrupting, when said discharge sensing means senses the trailing edge of the first document being discharged by said discharging means, an operation of said discharging means and causing, when said insertion sensing means senses a subsequent second document after said discharging means has nipped said trailing edge of said first document, said conveying means to convey said second document by a preselected distance and then stop conveying said second document.

3. The device as claimed in claim 2, further comprising alarm outputting means for outputting an alarm message when said insertion sensing means senses the second document after said discharging means has nipped said trailing edge of said first document.

4. The device as claimed in claim 2, further comprising commanding means for commanding, when conveyance of the second document is interrupted, said conveying means to again start conveying said second document, wherein in response to a restart command input on said commanding means, said control means causes said conveying means and said discharging means to again start operating without regard to whether or not a preselected period of time has elapsed since an interruption of conveyance of the second document.

5. The device as claimed in claim 4, further comprising alarm outputting means for outputting an alarm message when said insertion sensing means senses the second document after said discharging means has nipped said trailing edge of said first document.

6. The device as claimed in claim 2, wherein said control means causes, when a preselected period of time elapses since an interruption of conveyance of the second document, said discharging means to discharge the read first document and causes, when said insertion sensing means senses the second document, said conveying means to again start conveyance.

7. The device as claimed in claim 6, further comprising setting means for variably setting the preselected period of time.

8. The device as claimed in claim 7, further comprising commanding means for commanding, when conveyance of the second document is interrupted, said conveying means to again start conveying said second document, wherein in response to a restart command input on said commanding means, said control means causes said conveying means and said discharging means to again start operating without regard to whether or not the preselected period of time has elapsed since an interruption of conveyance of the second document.

9. The device as claimed in claim 8, further comprising alarm outputting means for outputting an alarm message when said insertion sensing means senses the second document.

10. The device as claimed in claim 6, further comprising a setting unit configured to variably set the preselected period of time.

11. The device as claimed in claim 10, further comprising a commanding unit configured to command, when conveyance of the second document is interrupted, said conveyor to again start conveying said second document, wherein in response to a restart command input on said commanding unit, said processor causes said conveyor and said discharging unit to again start operating without regard to whether or not the preselected period of time has elapsed since an interruption of conveyance of the second document.

12. The device as claimed in claim 11, further comprising an alarm unit configured to output an alarm message when said first sensor senses the second document.

13. A device for conveying documents, comprising:

insertion sensing means for sensing a first document inserted into said device;

conveying means for conveying the first document to a preselected reading position;

discharging means for driving the read first document out of said device;

discharge sensing means for sensing a trailing edge of the read first document at a position adjoining said discharging means;

control means for interrupting, when said discharge sensing means senses the trailing edge of the first document being discharged by said discharging means, an operation of said discharging means and inhibiting, when said insertion sensing means senses a subsequent said second document after said discharging means has nipped said trailing edge of said first document, said conveying means from conveying said new document or causing said conveying means to convey said second document by a preselected distance; and alarm outputting means for outputting an alarm message when said insertion sensing means senses the second document.

14. The device as claimed in claim 13, further comprising commanding means for commanding, when conveyance of the second document is interrupted, said conveying means to again start conveying said second document, wherein in response to a restart command input on said commanding means, said control means causes said conveying means and said discharging means to again start operating.

15. A device for conveying documents, comprising:

insertion sensing means for sensing a first document inserted into said device;

conveying means for conveying the first document to a preselected reading position;

discharging means for driving the read first document out of said device;

discharge sensing means for sensing a trailing edge of the read first document at a position adjoining said discharging means;

control means for interrupting, when said discharge sensing means senses the trailing edge of the first document being discharged by said discharging means, an operation of said discharging means and inhibiting, when said insertion sensing means senses a subsequent second document after said discharging means has nipped said trailing edge of said first document, said conveying means from conveying said second document or causing said conveying means to convey said second document by a preselected distance; and setting means for selectively inhibiting, when said insertion sensing means senses the second document, said conveying means from conveying said second document or causing said conveying means to convey said second document by a preselected distance.

16. The device as claimed in claim 15, further comprising alarm outputting means for outputting an alarm message when said insertion sensing means senses the second document.

17. A device for conveying documents, comprising:

insertion sensing means for sensing a first document inserted into said device;

conveying means for conveying the first document to a preselected reading position;

discharging means for driving the read first document out of said device;

discharge sensing means for sensing a trailing edge of the read first document at a position adjoining said discharging means;

control means for interrupting, when said discharge sensing means senses the trailing edge of the first document being discharged by said discharging means, an operation of said discharging means and inhibiting, when said insertion sensing means senses a subsequent second document after said discharging means has nipped said trailing edge of said first document, said conveying means from conveying said second document or causing said conveying means to convey said second document by a preselected distance;

commanding means for commanding, when conveyance of the second document is interrupted, said conveying means to again start conveying said second document; and setting means for selectively inhibiting, when said insertion sensing means senses the second document, said conveying means from conveying said second document or causing said conveying means to convey said second document by the preselected distances, wherein in response to a restart command input on said commanding means, said control means causes said conveying means and said discharging means to again start operating.

18. The device as claimed in claim 17, further comprising alarm outputting means for outputting an alarm message when said insertion sensing means senses the second document.

19. A device for conveying documents, comprising:

insertion sensing means for sensing a first document inserted into said device;

conveying means for conveying the first document to a preselected reading position;

discharging means for driving the read first document out of said device;

discharge sensing means for sensing a trailing edge of the read first document at a position adjoining said discharging means; and control means for interrupting, when said discharge sensing means senses the trailing edge of the first document being discharged by said discharging means, an operation of said discharging means and inhibiting, when said insertion sensing means senses a subsequent second document after said discharging means has nipped said trailing edge of said first document, said conveying means from conveying said second document or causing said conveying means to convey said second document by a preselected distance, wherein said control means causes, when said insertion sensing means senses the second document, said conveying means to convey said second document by the preselected distance, interrupts conveyance, and then causes, when said discharging sensing means senses the trailing edge of the read first document, said conveying means to again start conveying said second document.

20. The device as claimed in claim 19, further comprising commanding means for commanding, when conveyance of the second document is interrupted, said conveying means to again start conveying said second document, wherein in response to a restart command input on said commanding means, said control means causes said conveying means and said discharging means to again start operating.

21. The device as claimed in claim 20, further comprising setting means for selectively inhibiting, when said insertion sensing means senses the second document, said conveying means from conveying said second document or causing said conveying means to convey said second document by the preselected distance.

22. The device as claimed in claim 21, further comprising alarm outputting means for outputting an alarm message when said insertion sensing means senses the second document.

23. A device configured to convey documents, comprising:

a first sensor configured to sense a first document inserted into said device;

a conveyor configured to convey the first document to a preselected reading position;

a discharging unit configured to drive the read first document out of said device;

a second sensor configured to sense a trailing edge of the read first document at a position adjoining said discharging unit;

a processor configured to interrupt, when said second sensor senses the trailing edge of the first document being discharged by said discharging unit, an operation of said discharging unit and inhibit, when said first sensor senses a subsequent second document after said discharging unit has nipped said trailing edge of said first document, said conveyor from conveying said second document; and an alarm unit configured to output an alarm message when said first sensor senses the second document after said discharging unit has nipped said trailing edge of said first document.

24. A device configured to convey documents, comprising:

a first sensor configured to sense a first document inserted into said device;

a conveyor configured to convey the first document to a preselected reading position;

a discharging unit configured to drive the read first document out of said device;

a second sensor configured to sense a trailing edge of the read first document at a position adjoining said discharging unit; and a processor configured to interrupt, when said second sensor senses the trailing edge of the first document being discharged by said discharging unit, an operation of said discharging unit and causing, when said first sensor senses a subsequent second document after said discharging unit has nipped said trailing edge of said first document, said conveyor to convey said second document by a preselected distance and then stop conveying said second document.

25. The device as claimed in claim 24, further comprising an alarm unit configured to output an alarm message when said first sensor senses the second document after said discharging unit has nipped said trailing edge of said first document.

26. The device as claimed in claim 24, further comprising a commanding unit configured to command, when conveyance of the second document is interrupted, said conveyor to again start conveying said second document, wherein in response to a restart command input on said commanding unit, said processor causes said conveyor and said discharging unit to again start operating without regard to whether or not a preselected period of time has elapsed since an interruption of conveyance of the second document.

27. The device as claimed in claim 26, further comprising an alarm unit configured to output an alarm message when said first sensor senses the second document after said discharging unit has nipped said trailing edge of said first document.

28. The device as claimed in claim 24, wherein said processor causes, when a preselected period of time elapses since an interruption of conveyance of the second document, said discharging unit to discharge the read first document and causes, when said first sensor senses the second document, said conveyor to again start conveyance.

29. A device configured to convey documents, comprising:

a first sensor configured to sense a first document inserted into said device;

a conveyor configured to convey the first document to a preselected reading position;

a discharging unit configured to drive the read first document out of said device;

a second sensor configured to sense a trailing edge of the read first document at a position adjoining said discharging unit;

a processor configured to interrupt, when said second sensor senses the trailing edge of the first document being discharged by said discharging unit, an operation of said discharging unit and inhibit, when said first sensor senses a subsequent second document after said discharging unit has nipped said trailing edge of said first document, said conveyor from conveying said new document or causing said conveyor to convey said second document by a preselected distance; and an alarm unit configured to output an alarm message when said first sensor senses the second document.

30. A device configured to convey documents, comprising:

a first sensor configured to sense a first document inserted into said device;

a conveyor configured to convey the first document to a preselected reading position;

a discharging unit configured to drive the read first document out of said device;

a second sensor configured to sense a trailing edge of the read first document at a position adjoining said discharging unit;

a processor configured to interrupt, when said second sensor senses the trailing edge of the first document being discharged by said discharging unit, an operation of said discharging unit and inhibit, when said first sensor senses a subsequent second document after said discharging unit has nipped said trailing edge of said first document, said conveyor from conveying said second document or causing said conveyor to convey said second document by a preselected distance; and a setting unit for selectively inhibiting, when said first sensor senses the second document, said conveyor from conveying said second document or causing said conveyor to convey said second document by a preselected distance.

31. The device as claimed in claim 30, further comprising an alarm unit configured to output an alarm message when said first sensor senses the second document.

32. The device as claimed in claim 29, further comprising a commanding unit configured to command, when conveyance of the second document is interrupted, said conveyor to again start conveying said second document, wherein in response to a restart command input on said commanding unit, said processor causes said conveyor and said discharging unit to again start operating.

33. A device configured to convey documents, comprising:

a first sensor configured to sense a first document inserted into said device;

a conveyor configured to convey the first document to a preselected reading position;

a discharging unit configured to drive the read first document out of said device;

a second sensor configured to sense a trailing edge of the read first document at a position adjoining said discharging unit;

a processor configured to interrupt, when said second sensor senses the trailing edge of the first document being discharged by said discharging unit, an operation of said discharging unit and inhibit, when said first sensor senses a subsequent second document after said discharging unit has nipped said trailing edge of said first document, said conveyor from conveying said second document or causing said conveyor to convey said second document by a preselected distance;

a commanding unit configured to command, when conveyance of the second document is interrupted, said conveyor to again start conveying said second document; and a setting unit for selectively inhibiting, when said first sensor senses the second document, said conveyor from conveying said second document or causing said conveyor to convey said second document by the preselected distance, wherein in response to a restart command input on said commanding unit, said processor causes said conveyor and said discharging unit to again start operating.

34. The device as claimed in claim 33, further comprising an alarm unit configured to output an alarm message when said first sensor senses the second document.

35. A device configured to convey documents, comprising:

a first sensor configured to sense a first document inserted into said device;

a conveyor configured to convey the first document to a preselected reading position;

a discharging unit configured to drive the read first document out of said device;

a second sensor configured to sense a trailing edge of the read first document at a position adjoining said discharging unit; and a processor configured to interrupt, when said second sensor senses the trailing edge of the first document being discharged by said discharging unit, an operation of said discharging unit and inhibit, when said first sensor senses a subsequent second document after said discharging unit has nipped said trailing edge of said first document, said conveyor from conveying said second document or causing said conveyor to convey said second document by a preselected distance, wherein said processor causes, when said first sensor senses the second document, said conveyor to convey said second document by the preselected distance, interrupts conveyance, and then causes, when said discharging sensing means senses the trailing edge of the read first document, said conveyor to again start conveying said second document.

36. The device as claimed in claim 35, further comprising a commanding unit configured to command, when conveyance of the second document is interrupted, said conveyor to again start conveying said second document, wherein in response to a restart command input on said commanding unit, said processor causes said conveyor and said discharging unit to again start operating.

37. The device as claimed in claim 36, further comprising a setting unit for selectively inhibiting, when said first sensor senses the second document, said conveyor from conveying said second document or causing said conveyor to convey said second document by the preselected distance.

38. The device as claimed in claim 37, further comprising an alarm unit configured to output an alarm message when said first sensor senses the second document.

* * * * *